US005358295A

United States Patent [19]

Campbell

[11] Patent Number: 5,358,295

[45] Date of Patent: Oct. 25, 1994

[54] TONG/DISPOSABLE BAG COMBINATION

[76] Inventor: Donald G. Campbell, 236 Sunmills Place S.E., Calgary, Alberta, Canada, T2X 2P2

[21] Appl. No.: 210,745

[22] Filed: Mar. 21, 1994

Related U.S. Application Data

[63] Continuation of Ser. No. 72,085, Jun. 7, 1993, abandoned.

[51] Int. Cl.[5] ..... A01K 29/00; E01H 1/12

[52] U.S. Cl. ..... 294/1.3

[58] Field of Search ..... 294/1.3–1.5, 294/8.5, 11, 16, 25, 33, 99.2; 15/104.8, 257.1, 257.4, 257.6

[56] References Cited

U.S. PATENT DOCUMENTS

| | | | |
|---|---|---|---|
| 2,376,135 | 5/1945 | Frasher | 294/99.2 X |
| 3,138,211 | 6/1964 | Blom | 294/99.2 X |
| 3,367,336 | 2/1968 | Eizenberg | 294/99.2 X |
| 3,703,158 | 11/1972 | Lemler | 294/1.3 |
| 3,767,247 | 10/1973 | Wetzler | 294/1.3 |
| 4,097,082 | 6/1978 | Orofino | 294/1.4 |
| 4,154,389 | 5/1979 | Dell'Anno | 294/1.3 |
| 4,156,400 | 5/1979 | Migdal | 294/1.3 X |
| 4,188,055 | 2/1980 | Green | 294/1.3 |
| 4,273,370 | 6/1981 | Kjaer | 294/1.3 |
| 5,174,620 | 12/1992 | Huegelmeyer | 294/1.3 |
| 5,178,426 | 1/1993 | David et al. | 294/1.3 |

FOREIGN PATENT DOCUMENTS

| | | | |
|---|---|---|---|
| 2497849 | 7/1982 | France | 294/1.3 |
| 2652102 | 3/1991 | France | 294/1.3 |
| 8802356 | 4/1990 | Netherlands | 294/1.3 |
| 651873 | 10/1985 | Switzerland | 294/1.3 |
| 2227645 | 8/1990 | United Kingdom | 294/1.3 |

*Primary Examiner*—Johnny D. Cherry
*Attorney, Agent, or Firm*—Anthony R. Lambert

[57] ABSTRACT

A method of adapting tongs having a pair of pivotally connected arms for use with a disposable bag. The method involves the following described steps. Firstly, place a pair of opposed compressible contact members on an interior surface of the arms adjacent the pivotal connection. The contact members engage when the arms are partially closed and compress thereby permitting the arms to become fully closed. Secondly, place a bottom portion of a disposable bag between the opposed compressible contact members. Thirdly, partially close the tongs such that the contact members engage to tightly grip the bottom portion of the disposable bag. Fourthly, fold a peripheral edge of the disposable bag over tips of the arms. The disposable bag opens and closes with the manipulation of the arms.

1 Claim, 4 Drawing Sheets

TONG/DISPOSABLE BAG COMBINATION

This is a continuation of application Ser. No. 08/072,085 filed on Jun. 7, 1993, now abandoned.

The present invention relates to a method of adapting tongs having a pair of pivotally connected arms for use with a disposable bag.

BACKGROUND OF THE INVENTION

Tongs come in a variety of configurations and are used to pick up an infinite variety of objects. There are areas of use where sanitary considerations are important. In the food industry, care must be taken to ensure that the tongs used do not contaminate the food. With other uses the concern is exactly the opposite, attempting to prevent the object being picked up from contaminating the tongs.

Attempts have been made to address this problem by making disposable tongs, as is illustrated in U.S. Pat. No. 4,188,055 entitled "Disposable Shovel Tongs" which issued to Green in 1980. It would be preferable, however, if a disposable bag could be used with tongs, so that the bag could be disposed of after each use and not the tongs themselves. There are problems, however, in placing a bag on tongs and maintaining that bag in a position to permit use.

SUMMARY OF THE INVENTION

What is required is a method of adapting tongs having a pair of pivotally connected arms for use with a disposable bag.

According to one aspect of the present invention there is provided a method of adapting tongs having a pair of pivotally connected arms for use with a disposable bag. The method involves the following described steps. Firstly, place a pair of opposed compressible contact members on an interior surface of the arms adjacent the pivotal connection. The contact members engage when the arms are partially closed and compress thereby permitting the arms to become fully closed. Secondly, place a bottom portion of a disposable bag between the opposed compressible contact members. Thirdly, partially close the tongs such that the contact members engage to tightly grip the bottom portion of the disposable bag. Fourthly, fold a peripheral edge of the disposable bag over tips of the arms. The disposable bag opens and closes with the manipulation of the arms.

With the described method, the bottom portion of the disposable bag is grasped by the compressible contact members to hold it in place while the peripheral edge of the disposable bag is manipulated with the tips of the arms. This permits the disposable bag to form a sanitary shield between the object being picked up and the tongs.

According to another aspect of the invention there is provided tongs. The tongs includes a pair of pivotally connected arms. A pair of opposed compressible contact members are positioned on an interior surface of the arms adjacent the pivotal connection. The contact members engage when the arms are partially closed and then compress permitting the arms to become fully closed.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
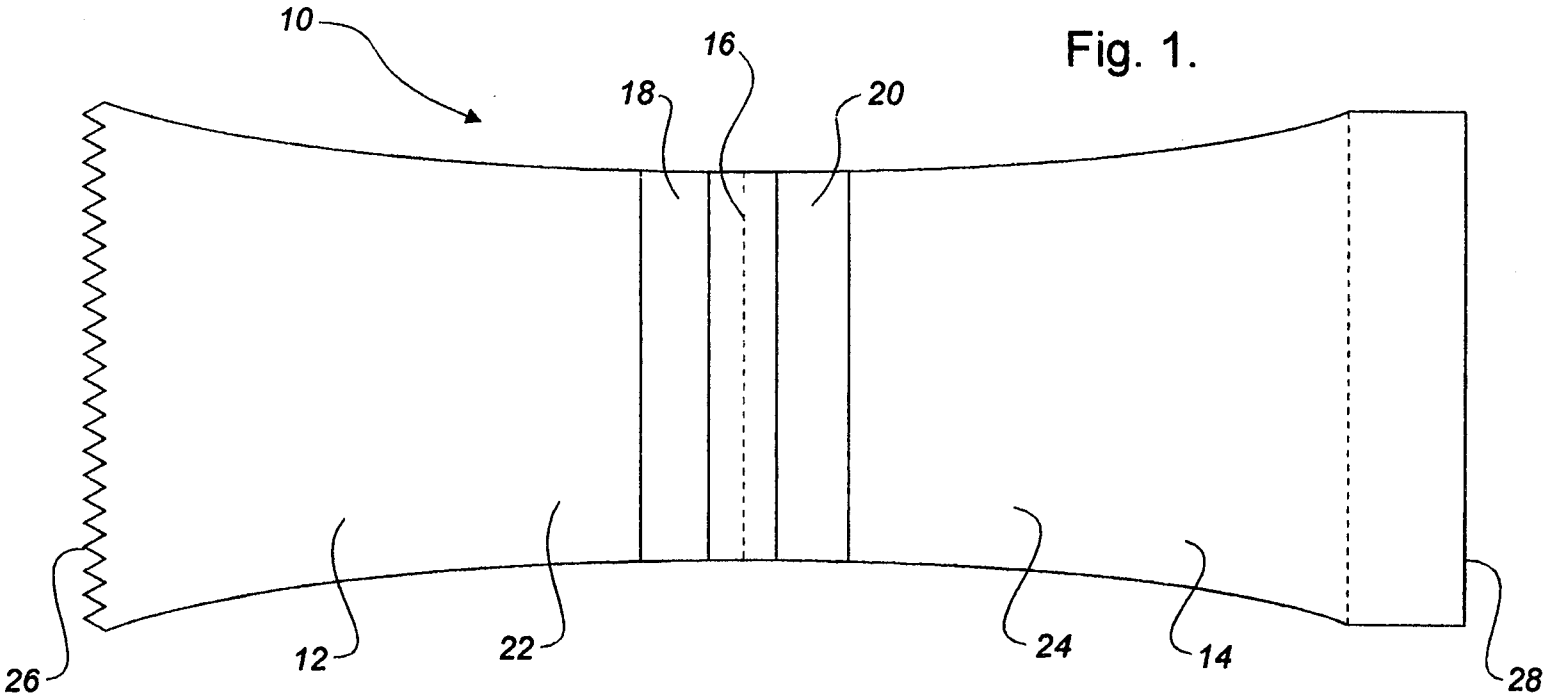
FIG. 1 is top plan view of tongs constructed in accordance with the teachings of the present invention.

The preferred embodiment, tongs generally identified by reference numeral 10, will now be described with reference to FIGS. 1 and 2. The preferred method will be described in association with the use of tongs 10, with reference to FIGS. 3 through 5.

Figure 2:
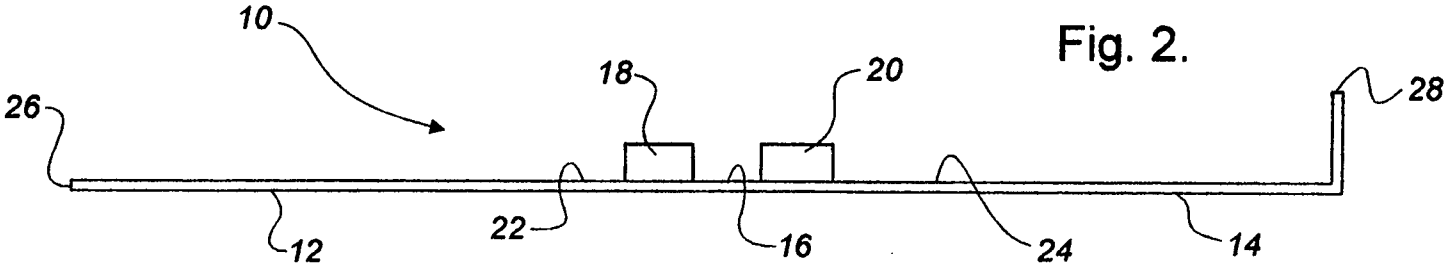
FIG. 2 is a side elevation view of the tongs illustrated in FIG. 1.

Referring to FIGS. 1 and 2, tongs 10 are constructed from a resilient sheet of material and include a pair of arms 12 and 14 pivotally connected at a fold line which serves as a pivotal connection 16. A pair of opposed compressible contact members 18 and 20 are positioned on an interior surface 22 and 24 of arms 12 and 14, respectively, adjacent pivotal connection 16. As will be hereinafter further described with respect to use and operation, contact members 18 and 20 engage when arms 12 and 14 are partially closed. Contact members 18 and 20 then compress permitting arms 12 and 14 to become fully closed. Each of arms 12 and 14 have tips 26 and 28, respectively. Arms 12 and 14 can be considered to be fully closed when tips 26 and 28 are substantially engaged or have an object engaged therebetween.

Figure 3:
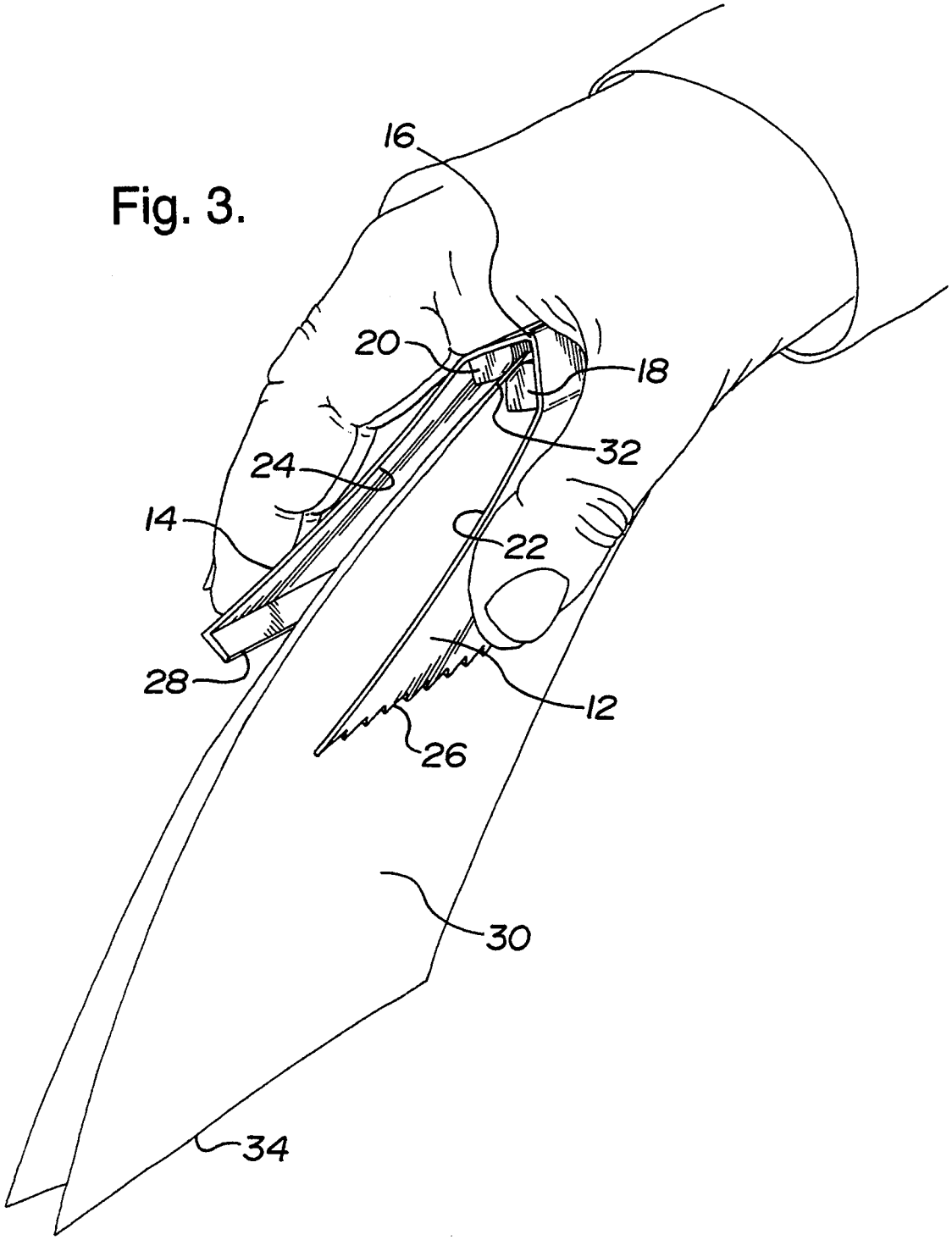
FIG. 3 is a first perspective view illustrating a step in the preferred method.
Figure 4:
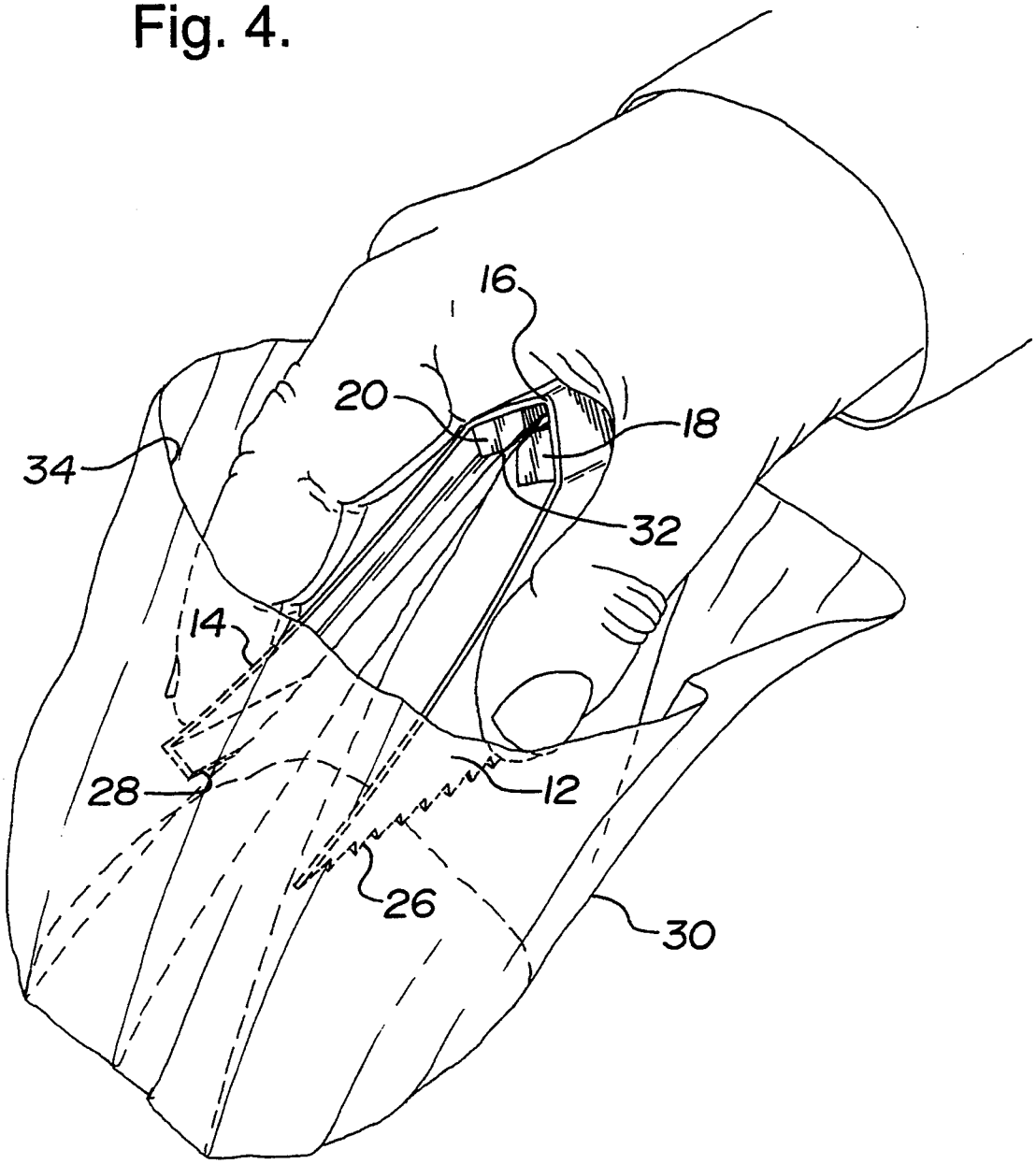
FIG. 4 is a second perspective view illustrating a step in the preferred method.
Figure 5:
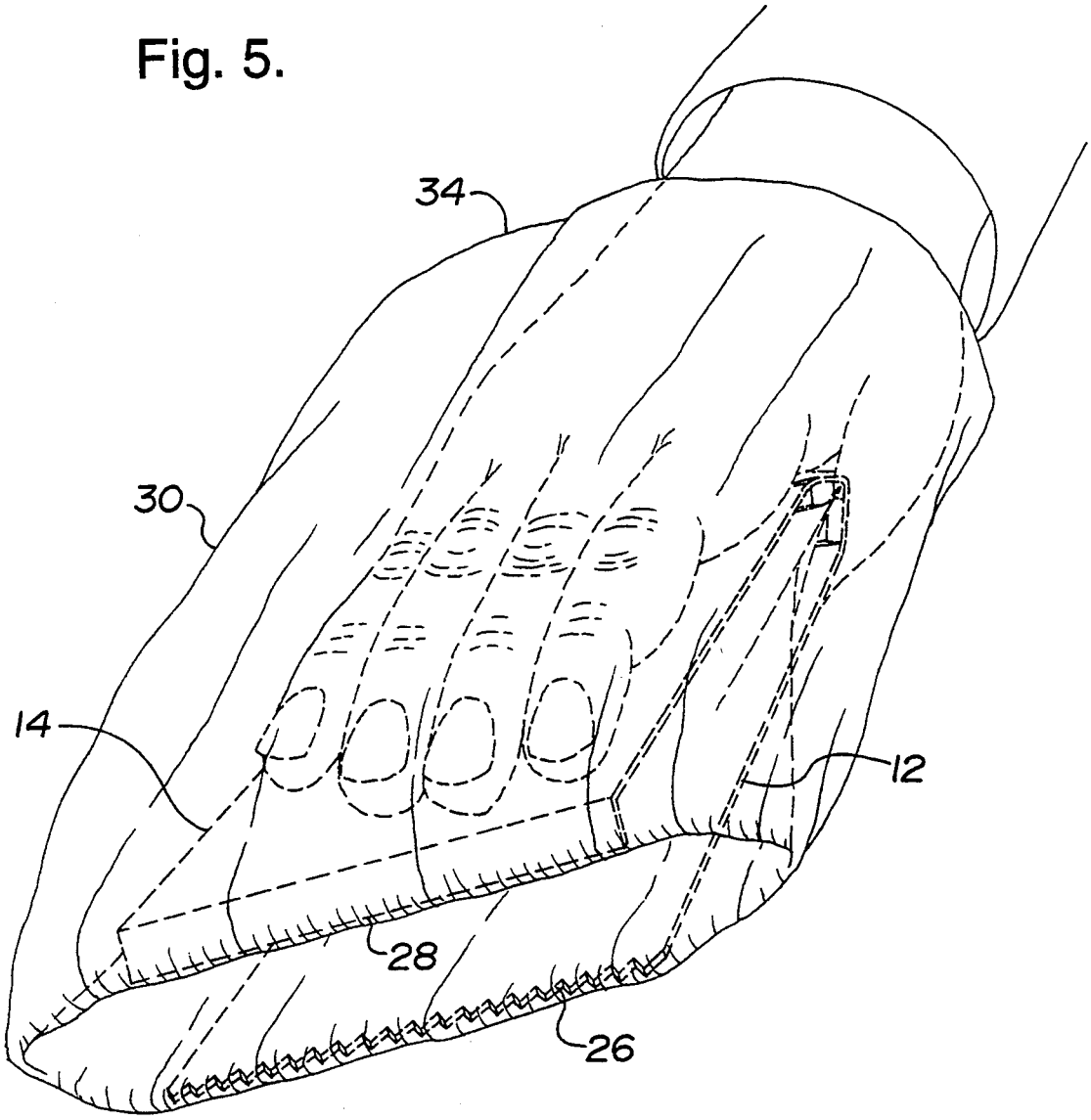
FIG. 5 is a third perspective view illustrating a step in the preferred method.

The use and operation of tongs 10 will now be described with reference to the preferred method. Tongs 10 are specially adapted for use with a disposable bag, identified by reference numeral 30. For the purpose of the description which follows, disposable bag 30 has a bottom portion 32 and a peripheral edge 34. The method involves the following described steps. Firstly, place opposed compressible contact members 18 and 20 on interior surfaces 22 and 24 of arms 12 and 14, respectively, adjacent pivotal connection 16, as illustrated in FIGS. 1 and 2. Contact members 18 and 20 engage when arms 12 and 14 are partially closed, as illustrated in FIGS. 3 and 4, and then compress thereby permitting arms 12 and 14 to become fully closed, as illustrated in FIG. 5. Secondly, place bottom portion 32 of disposable bag 30 between opposed compressible contact members 18 and 20, as illustrated in FIG. 3. Thirdly, partially close arms 12 and 14 of tongs 10 such that contact members 18 and 20 engage to tightly grip bottom portion 32 of disposable bag 30. Fourthly, fold peripheral edge 34 of disposable bag 30 over tips 26 and 28 of arms 12 and 14. With peripheral edge 34 engaged with tips 26 and 28, disposable bag 30 opens and closes with the manipulation of arms 12 and 14. With bottom portion 32 of disposable bag 30 grasped by compressible contact members 18 and 20 to hold it in place, full access is provided to disposable bag 30. When in use, disposable bag 30 forms a sanitary shield between any object being picked up and arms 12 and 14 of tongs 10.

It will be apparent to one skilled in the art that modifications may be made to the preferred embodiment without departing from the spirit and scope of the invention as defined by the claims.

The embodiments of the invention in which an exclusive property or privilege is claimed are defined as follows:

1. In combination:

a. tongs, comprising:

i) a resilient sheet of material folded to form two arms pivotally connected along a fold line, the arms having object engaging tips;

ii) a pair of contact members of a resilient compressible material on an interior surface of the arms adjacent to the pivotal connection, such that the contact members engage and compress as the arms are closed; and b. a disposable polymer plastic bag having a bottom and a peripheral edge defining an opening, the bottom of the bag being disposed between the contact members of the tongs and the peripheral edge being folded over the tips of the arms such that the bag serves as a sanitary shield between an object being picked up and the arms of the tongs.

* * * * *